US005604474A

United States Patent [19]

Leach et al.

[11] Patent Number: 5,604,474

[45] Date of Patent: Feb. 18, 1997

[54] FULL RANGE CURRENT LIMITING FUSE TO CLEAR HIGH AND LOW FAULT CURRENTS

[75] Inventors: John G. Leach; Ronald E. Bennett, both of Hickory, N.C.

[73] Assignee: KHT Fuses, L.L.C., Hickory, N.C.

[21] Appl. No.: 402,001

[22] Filed: Mar. 10, 1995

[51] Int. Cl.[6] ..... H01H 85/04

[52] U.S. Cl. ..... 337/158; 337/159; 337/162

[58] Field of Search ..... 337/158–164, 337/186, 144, 178, 280, 282

[56] References Cited

U.S. PATENT DOCUMENTS

| | | | |
|---|---|---|---|
| 3,801,947 | 4/1974 | Blewitt et al. | 337/246 |
| 3,840,836 | 10/1974 | Link | 337/292 |
| 3,921,116 | 11/1975 | Mikulecky | 337/202 |
| 4,123,738 | 10/1978 | Huber | 337/159 |
| 4,538,133 | 8/1985 | Pflanz | 337/4 |
| 4,626,817 | 12/1986 | Cameron | 337/162 |
| 4,689,596 | 8/1987 | Huber | 337/159 |

*Primary Examiner*—Leo P. Picard

*Assistant Examiner*—Jayprakash N. Gandhi

*Attorney, Agent, or Firm*—Deveau, Colton & Marquis

[57] ABSTRACT

An improved high voltage, full range, current limiting fuse with enhanced ability to dear high and low fault currents, even after the fuse has been subjected to a potentially damaging current surge, includes a sand-filled tubular housing with conductive terminals at either end and a dielectric support member supported therein about which a fusible structure is spirally wound. The fusible structure is electrically connected to the terminals and includes one or more high fault current interrupting elements for clearing high fault currents to which is mounted a low fault current interrupting assembly. The low fault current interrupting assembly includes a plurality of conductive components one of which is a damage sensor portion having a melting time-current characteristic which results in the damage sensor portion melting before the one or more high fault current interrupting elements. This enables the fuse to interrupt a low current which might exist after an element-damaging surge has occurred. A thermal shield mounted to the housing adjacent the low fault current interrupting assembly prevents damage to the housing caused by arcing in the low fault current interrupting assembly.

16 Claims, 3 Drawing Sheets

FULL RANGE CURRENT LIMITING FUSE TO CLEAR HIGH AND LOW FAULT CURRENTS

BACKGROUND OF THE INVENTION

1. Field of the Invention

This invention relates to electric current interruption devices and, more particularly, to high voltage current limiting fuses of the type known as "full range."

2. Description of the Related Art

A fuse is a protective device for electric circuits which has a fusible element that melts and opens to interrupt the circuit when subjected to excessive current. The melting occurs, in large part, due to $i^2R$ heating of the fusible element. A time delay occurs before circuit opening because the current which will cause the fusible element to operate or open must flow through the fusible element long enough for it to absorb sufficient heat to melt open. Thus, an important measure of the performance of a fuse is its time-current characteristic which is typically represented by a time-current curve which plots the logarithm of the time (in seconds) required for the fuse to operate versus the logarithm of the current in amperes. Other performance considerations include the continuous current rating which is the highest current the fuse can indefinitely pass without blowing, and the interrupting current rating which is the largest current that the fuse is capable of interrupting. For a given application, the value of the interrupting current rating should equal or exceed the largest current that the supply circuit is capable of providing.

A full range fuse is one which is capable of interrupting all values of current from its interrupting current rating down to the minimum continuous current that causes melting of the fusible element(s) with the fuse applied in a surrounding medium, in contact with the fuse, that is at the maximum temperature specified by the fuse manufacturer. One kind of such fuse employs two types of elements connected in a series electrical relationship. One element is primarily responsible for interrupting high fault currents, while the other element is primarily responsible for interrupting low fault currents, particularly very low currents. The ability of such a fuse to interrupt very low currents distinguishes "full range" fuses from other fuse types such as "back-up" and "general purpose" fuses.

U.S. Pat. No. 4,689,596 to Huber discloses a typical fuse employing the two element approach. The fuse includes a dielectric spider supporting a main or high fault current element and a secondary low fault current interruption fuse assembly connected in series therewith. The high fault current element is spirally wrapped around the dielectric spider and is electrically connected to one terminal cap. The low-fault current interruption fuse assembly is also spirally wrapped around the spider and is connected at one end to the high fault current element and at the other end to the other terminal cap. Such a fuse is referred to as the "dual element" type although the physical arrangement may involve more than two separate sections. For example, the high fault current element may be in two sections, with the low fault current assembly located between the two sections of the high fault current element. Such an arrangement is disclosed in U.S. Pat. No. 4,626,817 to Cameron.

A disadvantage of such fuses is their susceptibility to damage by a current surge having a magnitude in excess of the minimum current at which the high fault current element is designed to melt, yet of such short duration that the high fault current element only partially melts. Such damaging surges might be caused by transformer inrush currents, lightning surges, and the like. Should partial melting occur, the high fault current element may melt at a later time when the fuse is carrying a current less than the magnitude of current the high fault current element is designed to interrupt. Also, the fuse might be apt to fail to interrupt which, in turn, can result in the fuse catching fire and/or releasing ionized gas and flames with the potential for electrical flashover to adjacent energized parts. Thus, there is a need for a full range current limiting fuse with increased predictability of performance when subjected to electrical surges.

SUMMARY OF THE INVENTION

In accordance with the present invention, a high-voltage, full range current limiting fuse is provided which fulfills the above-stated need and comprises a housing filled with a granular dielectric material such as sand, a conductive terminal at each end of the housing, and a fusible element electrically connected to the terminals. The fusible element comprises one or more high fault current interrupting elements responsive to high fault currents and one or more low fault current interrupting assemblies connected in series therewith. The low fault current interrupting assembly includes a low melting point section and a damage sensor portion which has a melting time-current characteristic which causes the damage sensor portion to operate at current levels which would otherwise lead to the melting of the high fault current interrupting element(s), but in a shorter time. A dielectric tube surrounds the low fault current interrupting assembly and a thermal insulating shield is mounted to the inner surface of the housing adjacent the dielectric tube. Current interrupting is achieved by the low fault current interrupting assembly as a whole acting as an expulsion fuse while the low melting point section and/or the damage sensor portion initiate arcing. By initiating arcing in the low fault current interrupting assembly, the fuse of the present invention is capable of successfully interrupting currents even at a time subsequent to the damage sensor portion being damaged.

Thus, it is an object of the present invention to provide a current limiting fuse which is designed to control the location where electrically induced damages occur within the fuse.

It is another object of the present invention to provide an improved current limiting fuse which operates over a broad current range.

It is still another object of the present invention to provide a full range current limiting fuse which is capable of clearing fault currents in electrical circuits operating at high voltages.

Yet another object of the present invention is to provide a current limiting fuse with improved time-current characteristics.

These and other objects, features, and advantages of the present invention will become apparent from the following description when read in conjunction with the drawings.

DETAILED DESCRIPTION

Figure 1:
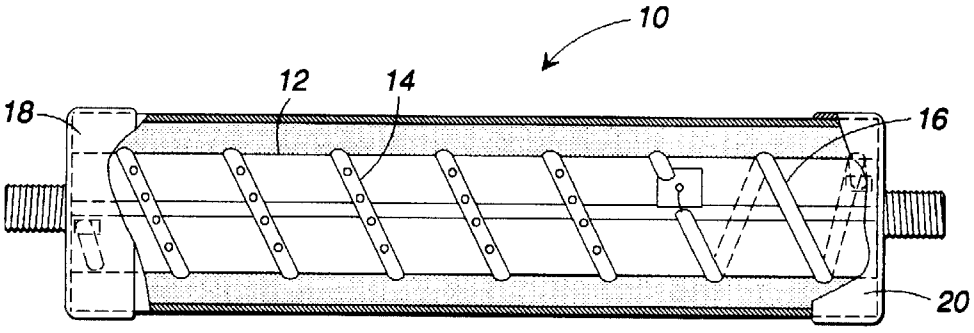
(PRIOR ART) FIG. 1
FIG. 1 is a cross sectional view of a prior art current limiting fuse showing a high fault current sensing element and a low fault current sensing element.

The significance of the present invention in relation to the existing state of the art will be best understood from a review of the structure and operation of a typical current limiting fuse of the dual element type in common use today. FIG. 1 illustrates a prior art dual element current limiting fuse 10. The fuse includes a dielectric spider 12 having a main or high fault current element 14, and a secondary, low fault current interruption fuse assembly 16 connected, in series with the high fault current element. The high fault current element is spirally wrapped around the dielectric spider 12 and is electrically connected to cap 18. The low-fault current interruption fuse assembly is also spirally wrapped around spider 12 and is connected at one end to element 14 and at the other end to cap 20.

Figure 2:
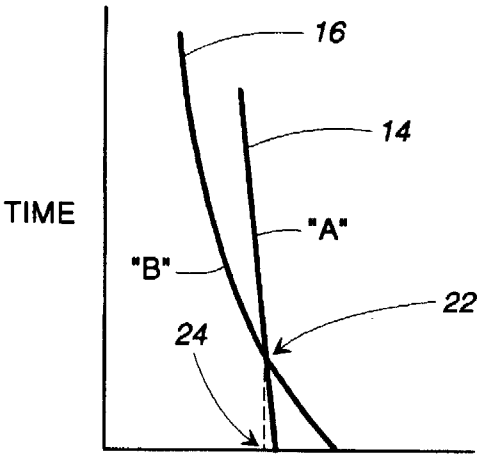
(PRIOR ART) FIG. 2
FIG. 2 is a plot of separate time-current curves for the high fault sensing element and the low fault sensing element depicted in FIG. 1.

As is generally understood in the art, the high fault current clearing or interruption characteristic is provided by means of fuse element 14 and the melting time-current curve for this element is shown in FIG. 2 as curve "A". The low fault current clearing or interruption characteristic is provided by low fault current interruption assembly 16 and its time-current curve is shown in FIG. 2 as curve "B" Low fault assembly 16 typically contains a relatively low melting point material such as tin to provide for element melting at relatively low currents without producing excessive fuse temperatures. In contrast, element 14 is usually a punched or notched ribbon or wires made from a relatively high melting point material such as silver or copper. It can be seen that characteristic curves "A" and "B" cross at point 22 corresponding to a threshold current 24.

Figure 3:
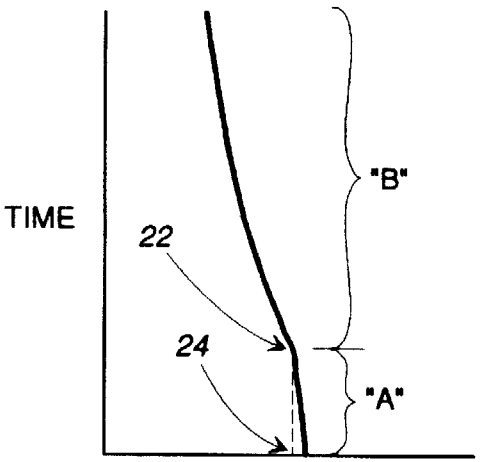
(PRIOR ART) FIG. 3
FIG. 3 is a composite of the time-current curves shown in FIG. 2.

The composite melting characteristic curve for the prior art device of FIG. 1 is shown in FIG. 3. For currents less than threshold current 24, low fault assembly 16 melts either alone or, for currents close to the crossover point 22, in conjunction with element 14. For currents higher than threshold current 24, element 14 melts alone, or in conjunction with assembly 16. Whether just one element melts or both elements melt depends on the current level and the arcing characteristics of the respective dement sections. However, it will be obvious to those skilled in the art that only a current of a magnitude higher than threshold current 24 is capable of melting element 14 and leaving assembly 16 intact.

A fuse of the type depicted in FIG. 1 is usually tested to ensure that currents higher than threshold current 24 can be interrupted by high fault element 14 alone, or in conjunction with low fault assembly 16, if arcing persists long enough for assembly 16 to also melt. A disadvantage of such a fuse design is its susceptibility to damage, misoperation, or failure by a current surge having a magnitude in excess of threshold current 24, but of such a short duration that it only partially melts element 14. The present invention significantly reduces the likelihood of such eventualities should the fuse be subjected to electrical surges.

Figure 4:
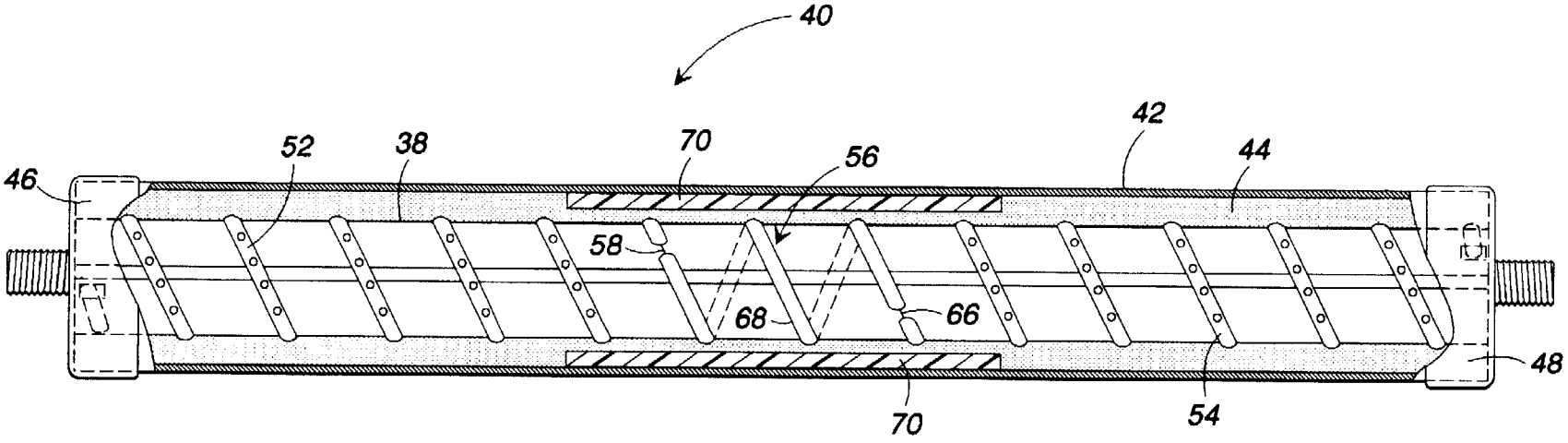
FIG. 4 is a cross sectional view of the preferred embodiment of current limiting fuse of the present invention.

The present invention includes an improved low fault current interrupting assembly in a dual dement, full range, current limiting fuse which operates such that the whole melting time-current characteristic curve of the fuse, from the lowest current which causes the fuse to melt up to the fuse's rated interrupting current, is controlled by the low fault current interrupting assembly. FIG. 4 shows a cross sectional view of the preferred embodiment of the present invention. In FIG. 4, the current limiting fuse of the present invention is generally indicated at 40 and comprises a tubular fuse holder or housing 42 having end caps or terminals 46, 48, a fusible structure comprising elements 52, 54, 56, and an optional supporting member for the fusible structure in the form of dielectric spider 38. Housing 42 is a cylindrical tubular member which may be composed of an insulated material such as a glass/epoxy composite or a ceramic material. The end caps or terminals 46, 48 are preferably formed of a highly conductive metal such as copper and may be retained in place in any suitable manner known to those skilled in the art.

The fusible structure preferably includes one or more fusible elements 52, 54 of high current clearing characteristics and one or more fusible elements such as fusible element 56 which has a low current clearing characteristic. Opposite ends of the fusible elements 52, 54 are connected to corresponding terminals. Thus, element 52 is electrically connected to terminal 46 and element 54 is electrically connected to terminal 48. The intermediately disposed fusible element 56 is connected at one end, via wire 58, to fusible element 52 and to the other fusible element 54 via wire 66. The resulting elongated fusible structure may be supported by and spirally wound around optional dielectric spider 38 which extends between and is preferably supported at terminals 46, 48.

A circuit through the fuse 40 extends from terminal 46 through element 52, element 56, and element 54, to terminal 48. The interior of the housing 42 is filled with a granular dielectric material 44 such as sand. Fusible elements 52, 54 are selected based on the desired current clearing characteristics and are preferably in the form of perforated or notched, ribbon-like metal having a relatively high melting point. Suitable metals for elements 52, 54 may be pure, or alloys of, copper, silver, aluminum, cadmium or zinc. Elements 52, 54 are preferably perforated and perform the current limiting function of the present invention by reducing the amount of current flowing in the circuit and reducing the amount of energy which is emitted or discharged during faults.

Figure 5:
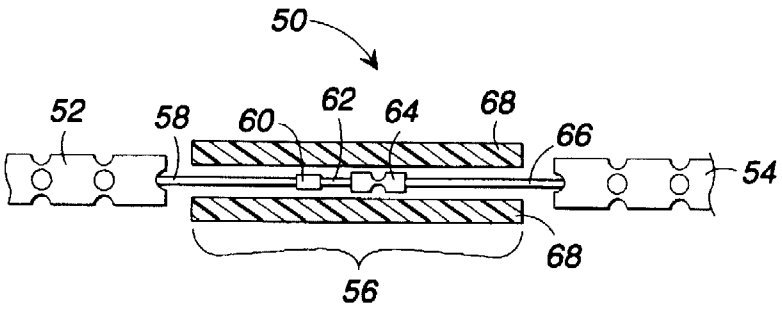
FIG. 5 is a schematic view of the fusible structure of the current limiting fuse of FIG. 4 illustrated in linear form.

FIG. 5 shows the fusible element 50 of the present invention in linear form for clarity. The fusible element 50 includes ribbon elements 52, 54 which are capable of interrupting high fault currents, welded to silver wires 58, 66, respectively. Wire 58 is attached to wire 60, a low melting point section, which, in turn, is attached to a short silver wire 62. Wire 60 is the primary component for initiating melting at low fault currents and may be formed of tin, lead, zinc, indium or alloys thereof. Wire 62 is welded to damage sensor 64 which has a melting characteristic, at short melting times, similar to those of element 52, 54. Damage sensor 64 is welded to silver wire 66. Components 58, 60, 62, 64, and 66 may be wholly or partially enclosed by a dielectric tubular member 68, preferably a silicone rubber tube. Tube 68 and the components it encloses form a type of expulsion fuse assembly in which gas produced from the arc breakdown of products in tube 68 assists in the elongation and de-ionization of the arc which, in turn, lead to the interruption of such current as causes the low fault current assembly 56 to melt.

Figure 6:
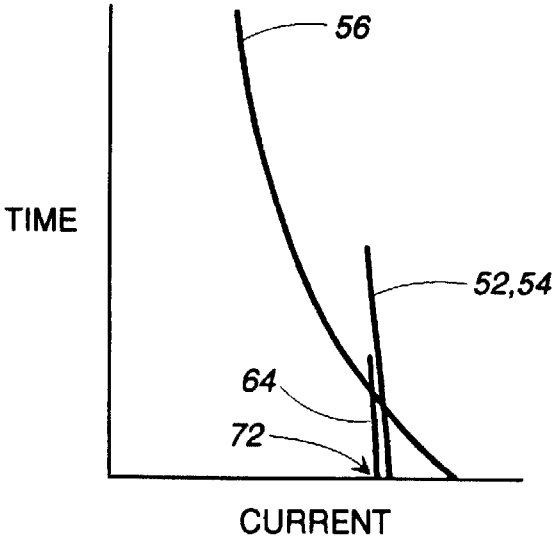
FIG. 6 is a plot of time-current curves for the preferred embodiment of the present invention as depicted in FIG. 4.

The melting time current characteristics of the various parts of the invention are shown in FIG. 6. Curve 56 is produced as a result of the thermal interaction of all components of the fuse, although wire 60 is the primary contributing element. Nevertheless, different parts of the fuse have a greater or lesser effect on different parts of the time current characteristic and those skilled in the art can manipulate the relative dimensions of these parts (e.g., diameter and length) and material compositions to obtain a desirable characteristic for the particular application at hand.

Damage sensor 64 has a melting characteristic designed to be below and to the left of the melting characteristic of curve 52, 54, for all currents above the "crossover" current 72 (i.e., the current corresponding to the point of intersection of curve 56 and curve 52, 54). The characteristics of damage sensor 64 are preferably controlled in production to ensure that this situation exists for all manufactured fuses, taking into account manufacturing tolerances of the element components. For example, the length or cross-sectional area and/or the material composition of damage sensor 64 may be strategically designed to achieve the desired heat flow characteristics relative to other elements of the fuse.

Figure 7:
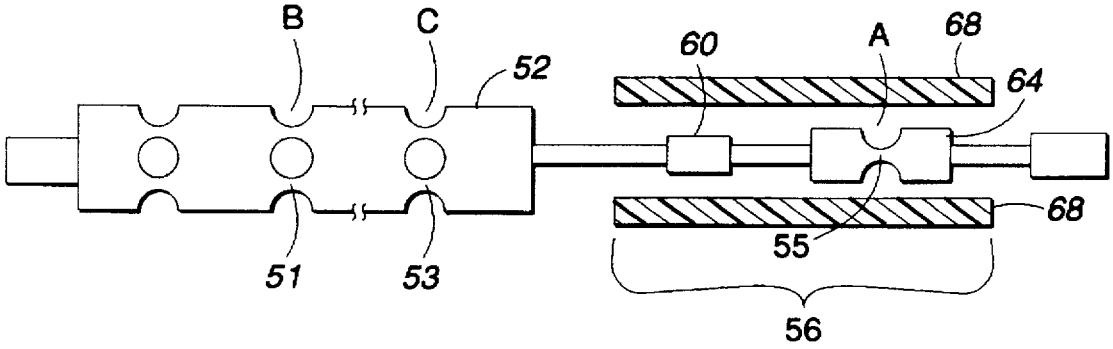
FIG. 7 is a schematic view of an alternate embodiment of the fusible structure of the present invention illustrated in linear form.

FIG. 7 is an illustration of a high current element 52 in series with low current element 56, containing damage sensor 64. From this alternate embodiment of the fusible structure of the present invention it may be seen that the cross-sectional areas of element 52, generally at B and C, may be designated as "b" and "c" respectively, while the cross-sectional area of the damage sensor 64, generally at A, is designated as "a". Thus, the restrictions 51, 53 formed by notches at B and C respectively, each have cross-sectional areas of approximately "b/2" and "c/2", respectively, while restriction 55 at A has a cross-sectional area of "a". Because of manufacturing tolerances, not all notches and restrictions in the ribbon are identical. For the sake of this discussion, assume the smallest cross-sectional area in element 52 is at notch B, while notch C has the largest cross sectional area. Therefore, in accordance with the preferred embodiment of the present invention the damage sensor 64 is made such that its cross-section "a" is less than "b" which is less than "c" (i.e., $a<b<c$).

Figure 8:
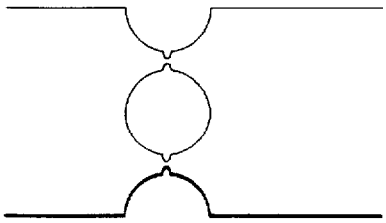
FIG. 8 is a graphical illustration of a damaged or partially melted notch of the type depicted in FIG. 7.

As surges of different magnitude and duration cause the notches to approach or exceed their melting temperature the notches do not melt simultaneously across their entire cross section, but instead, due to uneven current density, melt progressively. Thus, a sudden reduction in current can leave a notch partially melted or damaged as depicted in FIG. 8. This leaves a notch susceptible to melting at some later time, probably at a lower current than would otherwise cause melting of the high current element. Plain ribbon element 52 acting alone as the sole fusible component of the fuse would have difficulty interrupting currents below a certain level, i.e., its minimum interrupting current. Usually such currents do not produce melting of a sufficient number of series restrictions. For this reason, low current interrupting element 56 is connected in series with current element 52. A damaged high current restriction may, however, melt instead of the low current section, and at a current it cannot interrupt leading to fuse failure. Thus, the present invention provides a damage sensor 64 to greatly increase the likelihood that any arcing which occurs as a result of fuse damage (either immediately or at some later time) will be initiated in the low current section rather than in the high current element.

Preferably, damage sensor 64 is formed of the same material from which elements 52, 54 (FIG. 4) are formed. In this way, if any surge occurs which might damage element 52 or 54 by partial melting, for example, and thus create the potential for subsequent failure, the surge instead actually opens damage sensor 64 and arcing commences in the low current clearing assembly 56. The provision of silicon rubber tube 68 surrounding the conductive components of the low fault current interrupting assembly 56, in part, causes the damage sensor portion 64 of the low fault current interrupting assembly 56 to melt with all current higher than the "crossover" current 72 in a time slightly less than the melting time of the high fault current elements 52, 54 despite the fact that similar materials are used for the high fault current elements 52, 54 and the damage sensor portion 64 of the low fault current interrupting assembly 56.

Operation of the present invention in response to current surges of various magnitudes and durations is discussed below in connection with FIG. 7. In a first scenario, the surge is high enough to melt notch at B fully open and initiate arcing. If, after notch B melts, the current continues at about the same level for some appreciable time, all of the other notches, including notch C, will also melt and arc, and the current will be interrupted by the ribbon element 52 (a high fault current interruption). Damage sensor 64 at A will also melt and arc (slightly before notch B), but even if this current is too high for the low current section 56 to interrupt alone, this will not matter since multiple melting of notches in element 52 enables element 52 to interrupt. This situation exists for relatively high currents, for example, from the fuse's interrupting rating down to currents causing melting in about 0.01 seconds.

A second scenario presents a surge of lesser magnitude than that discussed above, so after notch B melts and arcs, notch C does not melt for some time. Some notches of intermediate cross-section to b and c will melt. If a sufficient number of notches melt, element 52 can interrupt, but if there are insufficient series arcs, the high current element 52 would be enable to interrupt the current. However, the damage sensor 64 will have been melted by the surge, so the low current section 56 will be capable of interrupting this current with or without "help" from element 52.

For a surge of the same magnitude as either of the scenarios discussed above which melts open notch B, but which is immediately reduced in magnitude such that few additional notches can melt high current element 52, element 52 would be unable to interrupt the reduced current, and failure would result. However, again damage sensor 64 will have melted open also, initiating arcing in the low current section 56. This section is capable of interrupting the low current.

A surge of sufficient magnitude and duration to only partially melt notch B could lead to full melting of notch B on a subsequent occasion when the fuse is carrying a current too low for the element 52 to interrupt, leading to fuse failure. However, the damage sensor 64 will either be fully melted open by this surge, allowing the low current section 56 to interrupt immediately, or it will be more severely damaged than element 52, making it very likely that any subsequent fuse melting will occur in the low current section 56, at damage sensor 64, which is capable of interrupting the current that causes the melting.

Finally, a surge of reduced magnitude and/or duration may partially melt damage sensor 64 but leave notch B intact. In this case, the fuse will be more susceptible to melting, either at rated current or on overload, depending on the extent of the damage, than would a fuse without a damage sensor. However, should the fuse melt open on other than a high fault, it will do so in the low current section 56 which is capable of interrupting such a current.

Referring now to FIGS. 4 and 5, it should be noted that one of the consequences of the features of the invention thus far described is that arcing occurs in the low current clearing assembly 56 for all currents which produce fuse element melting. Thus, even during high fault currents, arcing occurs in tube 68 due to damage sensor portion 64. This arcing assists in high current interruption by contributing an additional, small arc voltage to that generated by elements 52, 54 and by creating an isolating gap in the fuse element which decreases the possibility of the current re-striking and continuing to flow after a high current interruption. However, the hot gasses produced during the interruption process can have a deleterious effect on the fuse after interruption if they impinge on the fuse housing 42. Thus, if housing 42 is made of a glass/epoxy composite, this material may experience deterioration if the hot gasses from tube 68 impinge on it. This can occur when the gas passes through the space between grains of sand 44 which fill the space between tube 68 and housing 42. Thermal breakdown of the epoxy can occur causing smoking and, in some cases, gas release through the housing itself. This is particularly likely when fuse operation occurs at a high surrounding ambient temperature as is common when these devices are used to protect a transformer and the fuses are mounted inside the transformer. Alternatively, should an inert ceramic be used for housing 42, thermal cracking can occur with subsequent gas leakage, despite the fact that such materials are not subject to thermal degradation and breakdown. Therefore, a further aspect of the present invention is the provision of a thermal shield 70 that is incorporated into the fuse design to prevent such thermal problems.

Thermal shield 70 is preferably a piece of insulating material disposed along the inner surface of housing 42 adjacent fusible element 56 and having a high temperature tolerance. Such a component is preferably made from a mica-based material. For example, it has been found that a suitable thermal shield can be fabricated from silicon bonded mica paper having a thickness of as little as about 0.010 inches.

Thus, the present invention provides a full range current limiting fuse which has a damage sensor portion which controls where electrically induced damages occur within the fuse. By initiating arcing in the low current section, the fuse is capable of successfully interrupting even at times subsequent to the damage sensor 64 being damaged. Current interruption is achieved by the low current section 56 as a whole, acting as an expulsion fuse, while the low melting point section 60 and the damage sensor 64 initiate arcing.

Although the invention has been described with reference to preferred embodiments thereof; it is to be understood that these embodiments are merely illustrative of the application of the principles of the invention. Numerous modifications may be made therein without departing from the scope and spirit of the invention as set forth in the following claims.

What is claimed is:

1. A high voltage, full range current limiting fuse, comprising:

(a) a tubular housing filled with a granular dielectric material;

(b) a conductive terminal at each end of said housing; and (c) a fusible structure within said housing and electrically connected to said terminals, said fusible structure including one or more high fault current interrupting elements responsive to high fault currents, each having one of its ends electrically connected to one of said terminals, and one or more low fault current interrupting assemblies responsive to low fault currents and connected in series with at least one of said one or more high fault current interrupting elements, said one or more low fault current interrupting assemblies each having a plurality of electrical components including a damage sensor portion having a melting time-current characteristic which results in said damage sensor portion melting before said one or more high fault current interrupting elements for all currents which melt open or partially melt open said one or more high fault current interrupting elements, and a dielectric tubular member surrounding said plurality of electrical components of said low fault current interrupting assembly.

2. The fuse as recited in claim 1 further comprising a thermal shield mounted to said housing opposite said dielectric tubular member.

3. The fuse as recited in claim 1 further comprising a dielectric support positioned in said housing between said terminals wherein said fusible structure is spirally wound around said dielectric support.

4. The fuse as recited in claim 1 wherein said plurality of electrical components in said one or more low fault current interrupting assemblies further includes a low current melting component electrically connected to said damage sensor portion.

5. The fuse as recited in claim 4 wherein said low current melting component is formed of a material selected from the group consisting of tin, lead, zinc, indium, or alloys thereof.

6. The fuse as recited in claim 1 wherein said one or more high fault current interrupting elements comprise at least two high fault current interrupting elements having the same time-current characteristics.

7. The fuse as recited in claim 6 wherein said at least two high fault current interrupting elements are formed of the same material.

8. The fuse as recited in claim 6 wherein the material from which said at least two high fault current interrupting elements are formed is selected from the group consisting of copper, silver, aluminum, magnesium, cadium, zinc or alloys thereof.

9. The fuse as recited in claim 1 wherein said damage sensor portion and said one or more high fault interrupting elements have the same time-current characteristics.

10. The fuse as recited in claim 6 whereto said damage sensor portion and said at least two high fault interrupting elements are formed of the same material.

11. The fuse as recited in claim 1 whereto said granular dielectric material is sand.

12. The fuse as recited in claim 1 whereto said dielectric tubular member is formed of silicon rubber.

13. The fuse as recited in claim 2 whereto said thermal shield is formed of a mica-based material.

14. The fuse as recited in claim 1 whereto said tubular housing is formed of a glass/epoxy composite.

15. The fuse as recited in claim 1 whereto said tubular housing is formed of a ceramic material.

16. A high voltage, full range current limiting fuse, comprising:

(a) a tubular housing filled with granular dielectric material;

(b) a conductive terminal at each end of said housing;

(c) a dielectric support positioned in said housing between said terminals;

(d) a fusible structure spirally wound around said dielectric support and electrically connected to said terminals, said fusible structure including two high fault current interrupting elements with the same time-current characteristics responsive to high fault currents, each having one of its ends electrically connected to one of said terminals, and a low fault current interrupting assembly responsive to low fault currents and connected in series with said high fault current interrupting elements, said low fault current interrupting assembly having a damage sensor portion having a melting time-current characteristic which results in said damage sensor portion melting before said high fault current interrupting elements for all currents which melt open or partially melt open said high fault current interrupting elements, a low current melting component electrically connected to said damage sensor portion, and a dielectric tubular member surrounding said plurality of electrical components of said low fault current interrupting assembly; and (e) a thermal shield mounted to said housing opposite said dielectric tubular member.

* * * * *